US008925681B1

(12) United States Patent
Mattingly

(10) Patent No.: US 8,925,681 B1
(45) Date of Patent: Jan. 6, 2015

(54) SUSPENDABLE ULTRA-LIGHT CHAIR OR TOILET APPARATUS

(76) Inventor: Victor Raymond Mattingly, Louisville, KY (US)

( * ) Notice: Subject to any disclaimer, the term of this patent is extended or adjusted under 35 U.S.C. 154(b) by 106 days.

(21) Appl. No.: 13/065,211

(22) Filed: Mar. 16, 2011

(51) Int. Cl.
*A47C 4/00* (2006.01)
*A62B 35/00* (2006.01)
*A63B 29/02* (2006.01)

(52) U.S. Cl.
USPC ..... 182/7; 182/3; 297/16.1

(58) Field of Classification Search
USPC ..... 297/273, 16.1; 182/187, 3
See application file for complete search history.

(56) References Cited

U.S. PATENT DOCUMENTS

| | | | | | |
|---|---|---|---|---|---|
| 119,997 | A | * | 10/1871 | Rice | 188/65.5 |
| 1,306,041 | A | | 6/1919 | Wittman | |
| 1,663,966 | A | | 3/1928 | Ament et al. | |
| 1,740,949 | A | * | 12/1929 | Luery | 297/274 |
| 2,053,586 | A | | 9/1936 | Tohrner | |
| 2,376,036 | A | | 5/1945 | Cotton | |
| 2,960,180 | A | * | 11/1960 | Wachtel | 182/3 |
| 3,067,061 | A | | 11/1962 | Bertram | |
| 3,340,828 | A | | 9/1967 | Smith et al. | |
| 3,513,940 | A | | 5/1970 | Ussery | |
| 3,869,021 | A | * | 3/1975 | Sutherland et al. | 182/3 |
| 4,120,379 | A | | 10/1978 | Carter | |
| 4,197,816 | A | * | 4/1980 | Lusch | 182/3 |
| 4,515,240 | A | * | 5/1985 | Curtis | 182/6 |
| 4,667,772 | A | * | 5/1987 | Kammerer | 182/6 |
| 4,903,355 | A | * | 2/1990 | Hickerson | 5/83.1 |
| 4,909,353 | A | | 3/1990 | Govin | |
| 4,936,416 | A | | 6/1990 | Garon et al. | |
| 4,991,689 | A | * | 2/1991 | Cole | 182/3 |
| 5,083,324 | A | | 1/1992 | Strong | |
| 5,307,526 | A | * | 5/1994 | Appleby | 4/460 |
| 6,023,792 | A | | 2/2000 | Croucher et al. | |
| 6,081,942 | A | | 7/2000 | Bellamy | |
| 6,142,567 | A | * | 11/2000 | Bentley | 297/273 |
| 6,546,569 | B2 | * | 4/2003 | Figueras | 4/483 |
| 6,571,402 | B1 | | 6/2003 | Dobron | |
| 7,036,628 | B2 | * | 5/2006 | Wilcox et al. | 182/9 |
| 7,103,926 | B1 | | 9/2006 | Rasberry | |
| 7,200,878 | B2 | | 4/2007 | Payne | |

(Continued)

*Primary Examiner* — David R Dunn
*Assistant Examiner* — Richard Lowry
(74) *Attorney, Agent, or Firm* — John M. Bradshaw; Overhauser Law Offices LLC

(57) ABSTRACT

A ultra-light, concealable toilet or chair apparatus (10) configured to be suspended from an object to suspend the apparatus above ground is provided. The apparatus comprises of a suspension system (12) configured to be coupled to the object to suspend the apparatus above the ground. The suspension system includes at least one securing device (12) (14) coupled through the primary tensile support member (20) which extends downwardly and sub-divides into left linear side (20*a*) and right linear side (20*b*) portion that transitions into a concaved seat when human sits there on, provided, adjustable interlocking latch (22*a*) is coupled to corresponding ridged interlocking latch (30*e*), and adjustable interlocking latch (22*b*) is coupled to corresponding ridged interlocking latch (30*f*), forming a pair of loops that will surround left and right legs of the human operator, completing structural support. Clasp (36*g*) and clasp (36*i*), located at predetermined locations on the underside of left linear portion (20*a*), and first linear strap (28*c*), clasp (36*h*), and clasp (36*j*) located at corresponding locations on underside of right linear portion (20*b*), and second linear strap (28*d*), form securing points for an optional refuse bag (40), optional knee pads (38*a*) and (38*b*) can be added by sliding left linear side (20*a*) and right linear side (20*b*) through pre-manufactured slots in said knee pads.

18 Claims, 12 Drawing Sheets

(56) References Cited

U.S. PATENT DOCUMENTS

| | | | | |
|---|---|---|---|---|
| 7,490,610 | B2 * | 2/2009 | Franklin | 128/875 |
| 7,627,912 | B1 * | 12/2009 | McKinney | 5/81.1 R |
| 7,770,242 | B2 * | 8/2010 | Sell | 4/484 |
| D625,795 | S * | 10/2010 | Sexton | D23/311 |
| 7,927,321 | B2 * | 4/2011 | Marland | 604/353 |
| 7,980,524 | B2 * | 7/2011 | Parker | 248/317 |
| 8,061,481 | B2 * | 11/2011 | Wolner et al. | 182/3 |
| 8,292,028 | B2 * | 10/2012 | Wise | 182/3 |
| 2004/0154863 | A1 * | 8/2004 | Green | 182/7 |
| 2006/0113147 | A1 * | 6/2006 | Harris | 182/3 |
| 2009/0200106 | A1 * | 8/2009 | McKay et al. | 182/3 |
| 2010/0300802 | A1 * | 12/2010 | Kopp | 182/3 |

* cited by examiner

SUSPENDABLE ULTRA-LIGHT CHAIR OR TOILET APPARATUS

CROSS-REFERENCE TO RELATED APPLICATIONS

Not Applicable

FEDERALLY SPONSORED RESEARCH

Not Applicable

SEQUENCE LIST OR PROGRAM

Not Applicable

FIELD OF INVENTION

This invention relates generally to a portable, ultra-light toilet or chair apparatus and more particularly to a machine washable, concealable, flexible, toilet or chair apparatus that can be suspended from an object above the ground in conjunction of a human anchor structural support system.

BACKGROUND OF THE INVENTION

Since the dawn of man continuing forward to the present day, man has pursued the quest for the perfect "lue". Like the proverbial "gold ring", perfection is hard to achieve.

Early caveman were quite happy with just squatting down behind a tree or bush to defecate, because toilets and under pants had not yet been invented, and going back in time even further, back to the Cro-Magnon man, defecating was done much the same way, except the trees and bushes were optional!

Moving forward in time, man came up with an ingenious device called the "out house". There were single hole, and double hole units to choose from, however, these devices created more comfort for the user, but eliminated portage capability for the average traveler.

Moving forward to the present day, we now use water flush toilets with containment systems in place. These systems will probably be in service for many years to come, however, we did cut back to just one hole!

Man has always strived to advance himself to create a more comfortable world for his self, however, the twentieth century has become a rat-race. To find relief from the hussle and bussle of today's life style, many people now pursue adventures in the outdoors.

Outdoor recreation is enjoyed by millions of people, young and old alike. We can go just about anywhere, and do, however, toilet facilities may not be available when and where you need them. Hence the need for an ultra-light, concealable, waste containment toilet or chair apparatus that one may carry around with them, anywhere, effortlessly, and could be used for work or recreation.

DISCUSSION OF PRIOR ART

Many clever inventions have been invented over the years to remedy our mobile toiletry needs.

One such invention, Dobron, U.S. Pat. No. 6,571,402B1. This device couples into the receiver of an automobile trailer hitch for support. Although easy to assemble and use, it cannot be used away from an automobile, and not all automobiles have trailer hitches.

Another clever invention, Rasberry, U.S. Pat. No. 7,103,926B1. This invention is on the right track, however, as a hunter myself, I know that the four legs of this device would quickly sink into the soft earth of the deep woods, and further, the legs themselves could cause a problem because the ground is rarely level. The invention supports a D-ring to hang the device from on ones backpack for portage, however, most backpackers could find this unfavorable because of its size, it's weight, and it's visibility.

Another device, Bellamy, U.S. Pat. No. 6,081,942, is fashioned after the modern portable tree stand which is also supported above the ground by hanging the device from a tree trunk, using a pinching or leveraging technology. This device could be very functional around a base camp, but is probably too heavy to be carried very far by an individual on a back country excursion.

Still another device, Bentley, U.S. Pat. No. 6,142,567, is a strap device that would hang from a bathroom stalls walls, or from two trees. Although functional, this device could be dangerous to use in a public restroom. Three problems come to mind, first, bathroom stall walls were not designed to be hanging from, second, the hooks used to support the device from the stall walls could slide backwards as the user tries to mount the device, causing injury, and third, the swing-set style seat would tend to squeeze ones buttocks together, not a favorable position for this function! The tree hanging method could also be difficult. Finding two limbs in the woods at just the right height and distance apart, could be too time consuming a task when time could be an issue for the user!

Still yet another invention, Figueras, U.S. Pat. No. 6,546,569B2, is very close to perfection. This tree hanging toilet apparatus using an array of straps to support a ridged toilet seat with a hard metal support mechanism to connect the two. This device looks very functional and is possibly very comfortable, however, the hard form toilet seat is bulky and large, and the metal support device together with the toilet seat and supporting straps would probably be way to heavy for most outdoorsmen to consider as a main-stay piece of equipment on a hiking journey.

SUMMARY OF THE INVENTION

In view of the foregoing background, it is therefore an object of the present invention to provide a non-ridged, pocket-sized, portable, toilet or chair apparatus comprising of flexible strap material, with fasteners, configured in such a way as to support a human while in a sitting position, in conjunction of a suitable above ground support structure, is provided.

OBJECTS AND ADVANTAGES OF INVENTION

Accordingly, besides the objects and advantages of the flexible chair of toilet apparatus described in my above patent, several objects and advantages of the present invention are:

(A) To provide an apparatus which can be produced in a variety of colors without requiring the manufacturer to use a compounding facility for the production of the apparatus;

(B) To provide an apparatus whose production allows for a convenient and extremely rapid and economical change of color in the apparatus that are being produced;

(C) To provide an apparatus which is both flexible and extremely strong;

(D) To provide an apparatus which can be color coded for ease of operation;

(E) To provide an apparatus which will not be slippery when handled with wet or greasy fingers; Further objects and advantages are to provide a apparatus which can be used easily and conveniently by a human to sit there on or for human defecating, without any damage to the apparatus, which is simple to use and inexpensive to manufacture. still further objects an advantages (F) The entire apparatus is washing machine safe;

(G) Apparatus is compactable enough to fit into a bellows pocket, a purse, or fanny-pack;

(H) Can be deployed quickly and silently;

(I) Can be deployed on a hunters portable tree stand;

(J) Would be extremely useful for situations where human waste excrement must be removed from premises, such as in rock climbing, mountaineering, boating, camping, hiking or used indoors;

(K) Offers freedom of movement and would be an excellent option for the elderly or persons with week knees.

DRAWINGS

Figures

In the drawings, like elements are assigned like reference numbers and different alphabetical suffixes. Drawings are not necessary to scale.

FIG. 1 Depicts embodiment of a deployed suspendable toilet or chair apparatus in accordance with present invention.

FIG. 2 Demonstrates pre-assembly exploded view by number.

Figure 6A:
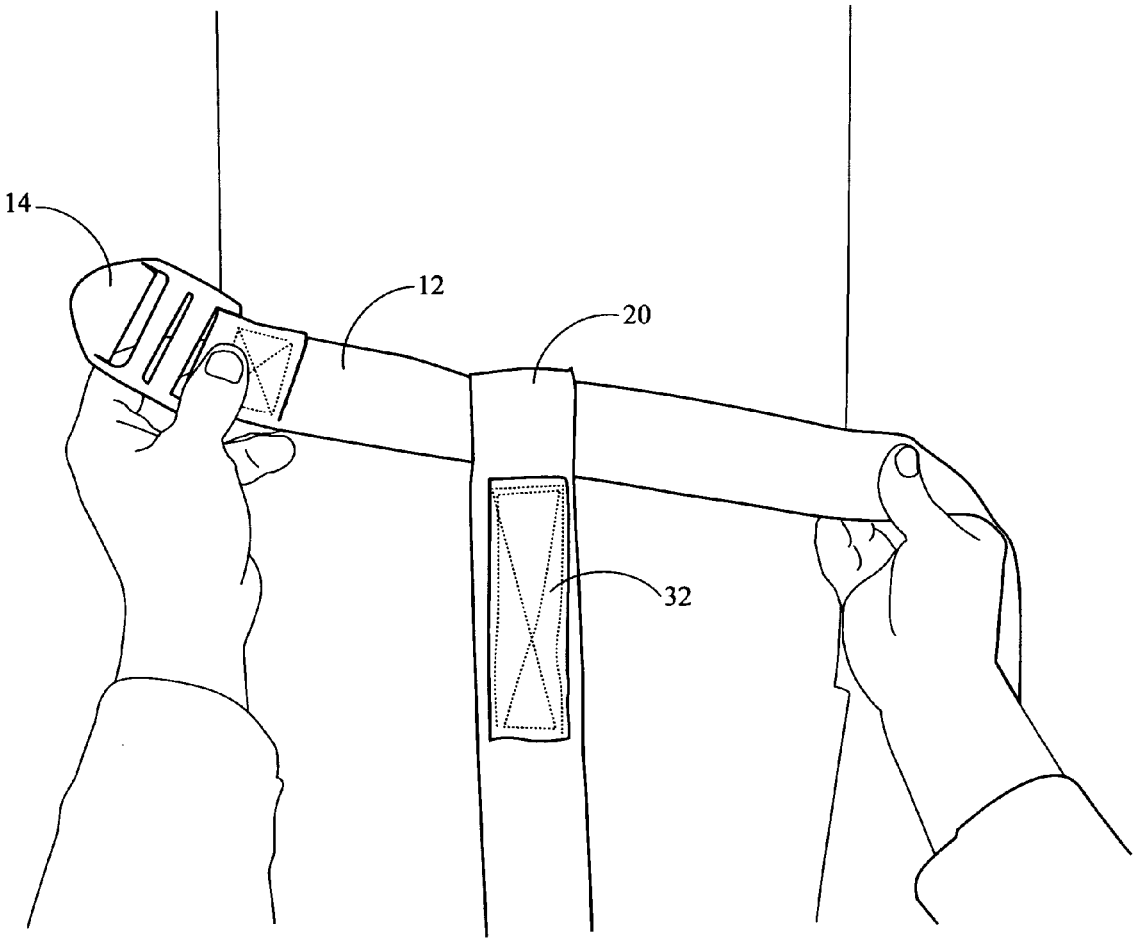

FIG. 6*a* . . . 6*g* Illustrates visual deployment instructions.

This invention is capable of other embodiments and of being practiced or of being carried out in various ways. It is to be understood that the phraseology and terminology used herein is for the purpose of description and should not be regarded as limiting. It is to be further understood that the invention is not limited in its application to the details of construction and the arrangements of components set forth in the following descriptions or illustrations in the drawings.

DRAWINGS

Reference Numerals

10 Suspended toilet or seating apparatus
12 Support belt
14 Support belt buckle
20 Main strap-top
20*a* Main strap—left linear side
20*b* Main strap—right linear side
22*a* Adjustable interlocking latch—male end
22*b* Adjustable interlocking latch—male end
24 Seat box assembly—S.B.A.
26 Transverse strap
28*c* First linear strap
28*d* Second linear strap
30*e* Ridged interlocking latch—female end
30*f* Ridged interlocking latch—female end
32 Hook portion—of hook and loop material
34*a* Loop portion—of hook and loop material
34*b* Loop portion—of hook and loop material
36*g* Clasp
36*h* Clasp
36*i* Clasp
36*j* Clasp
38*a* Knee pad
38*b* Knee pad
40 Refuse

DETAILED DESCRIPTION OF THE PREFERRED EMBODIMENTS

The present invention provides a compactable, ultra-light, machine washable, highly portable, chair or toilet apparatus for indoor or outdoor use. The apparatus is configured to be suspended above the ground to a suitable supporting structure, and around the legs of the person sitting there on. The expression 'suitable supporting structure' is to be defined broadly and indicate any structure that is available and will properly support the apparatus of the present invention. The term 'above the ground' may be applied to indicate a floor level (inside a structure), or the actual level of the ground surface (outdoor site). Outdoor suitable structures would include, but not limited to, a tree trunk, a fence post, telephone pole, mountaineering gear (such as rope, hexes, and cams). Could also be deployed in over road tractors, airplanes, campers or boats. Suitable indoor structures could include, but not limited to, door knobs, chair backs, closet hanger rod, bedpost, etc. Skilled persons will appreciate the variety of suitable support structures that maybe employed to suspend the present invention.

Figure 1:
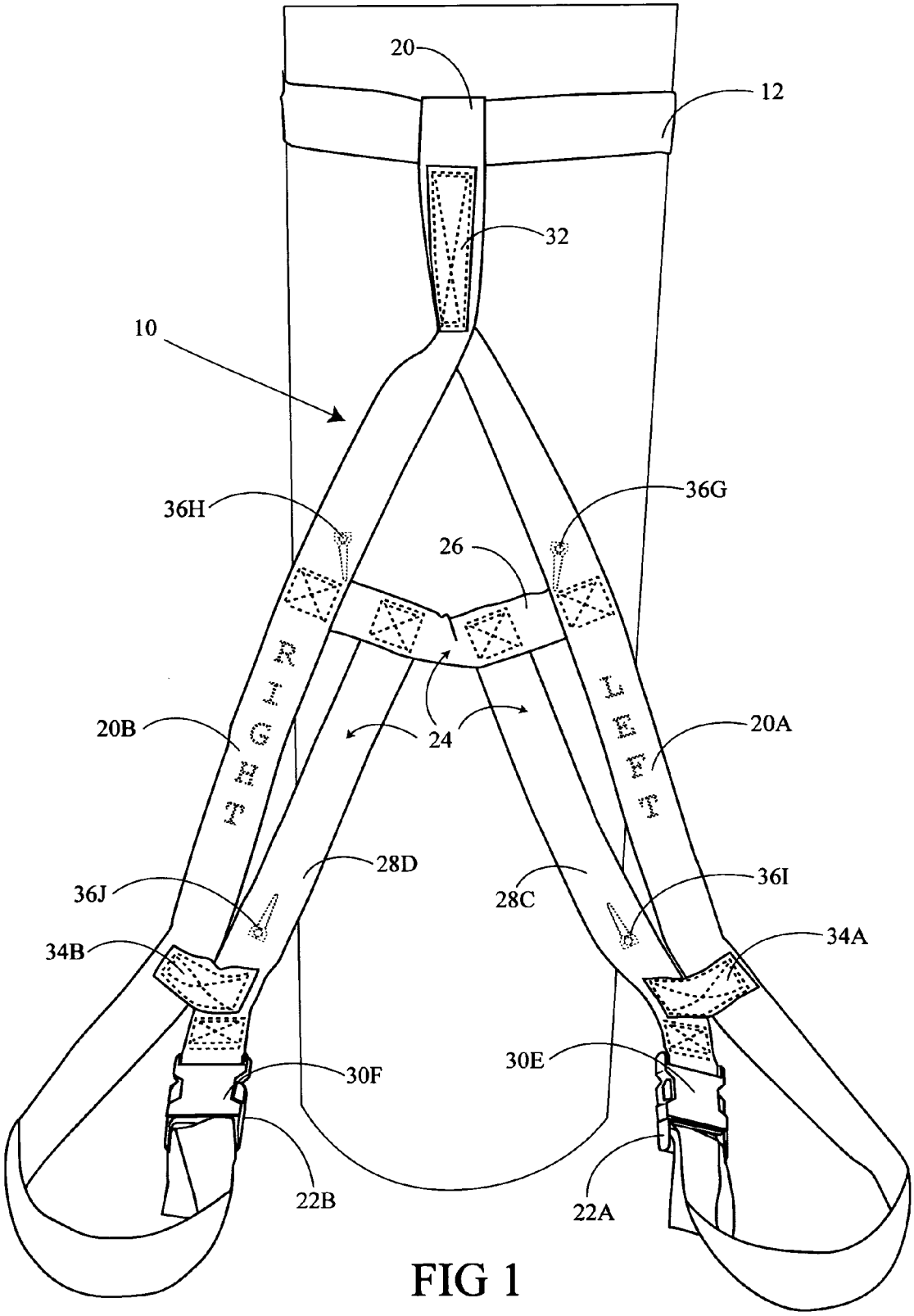
Figure 2:
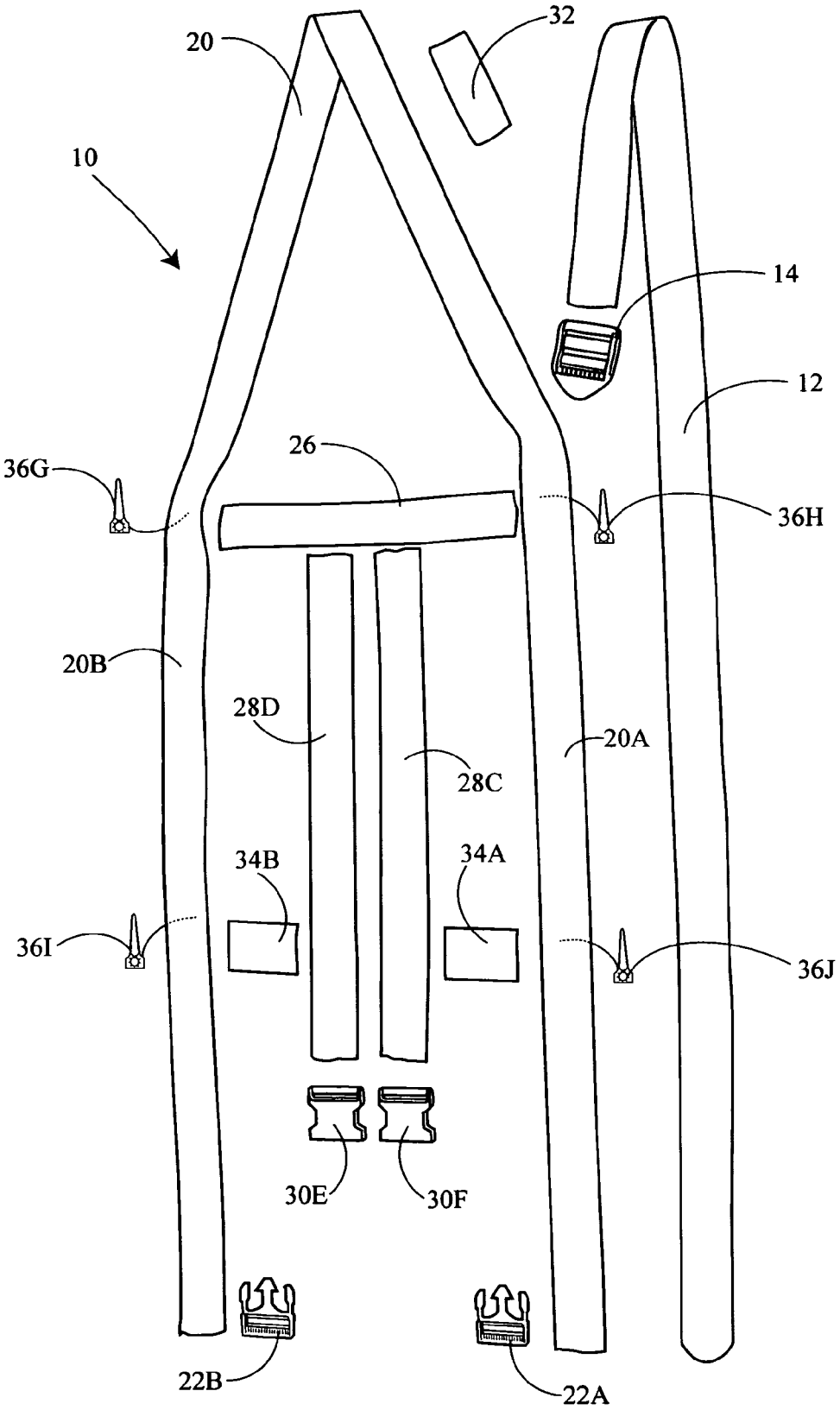
Figure 3:
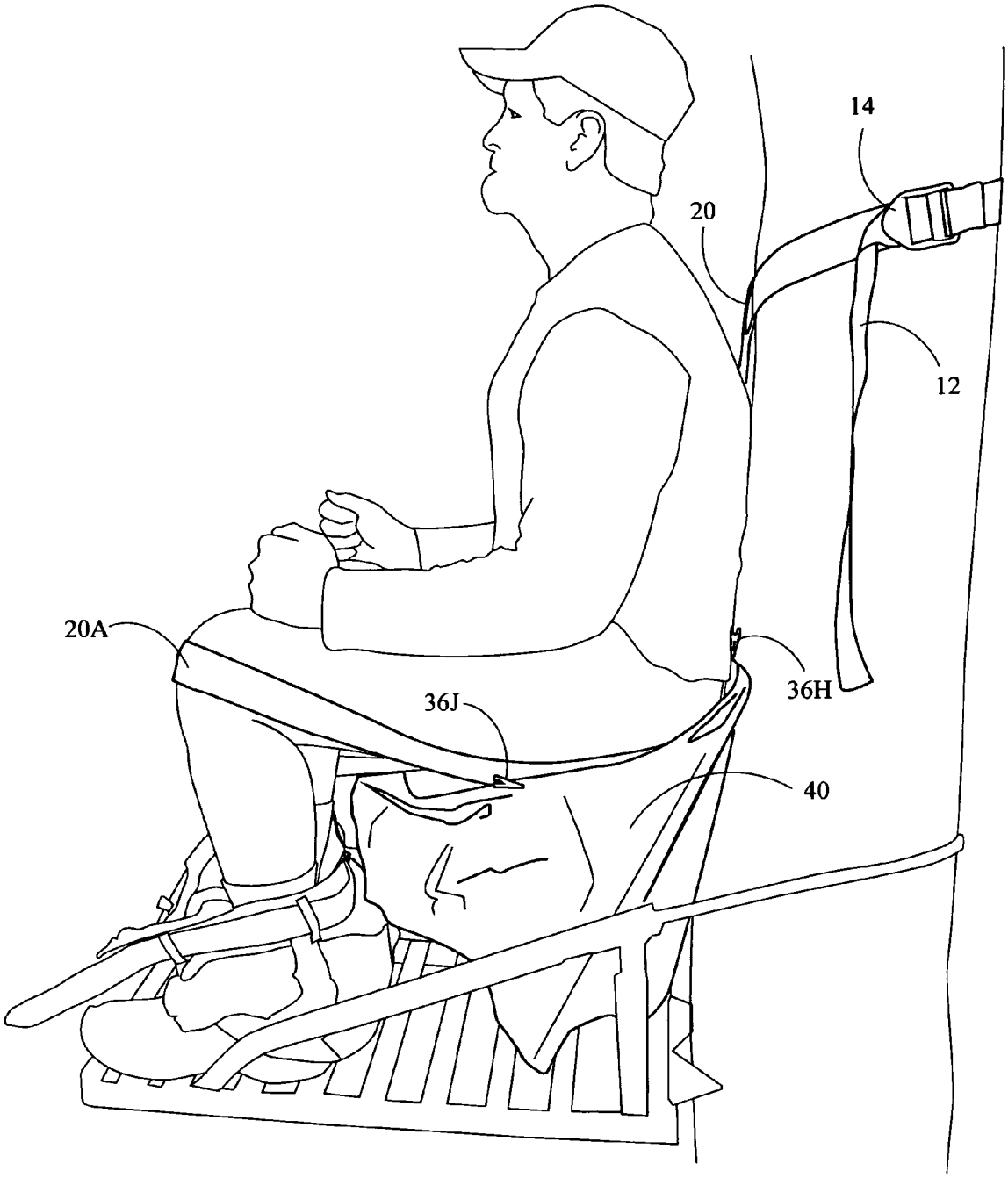
FIG. 3 Illustrates present invention deployed in conjunction with portable hunter's tree stand with biodegradable waste bag attached.
Figure 4:
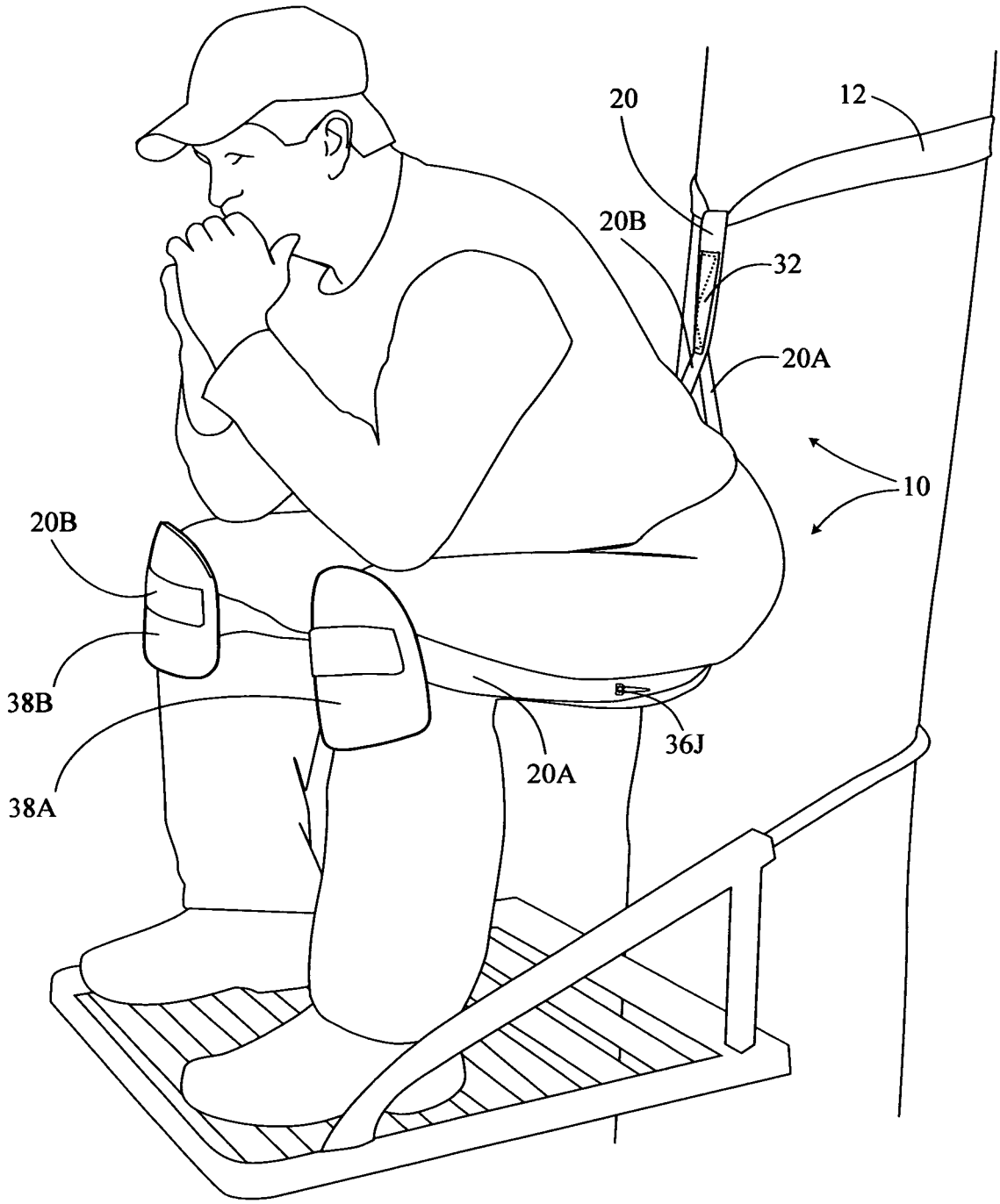
FIG. 4 Illustrates apparatus with additional comfort knee pads embellishment.
Figure 5:
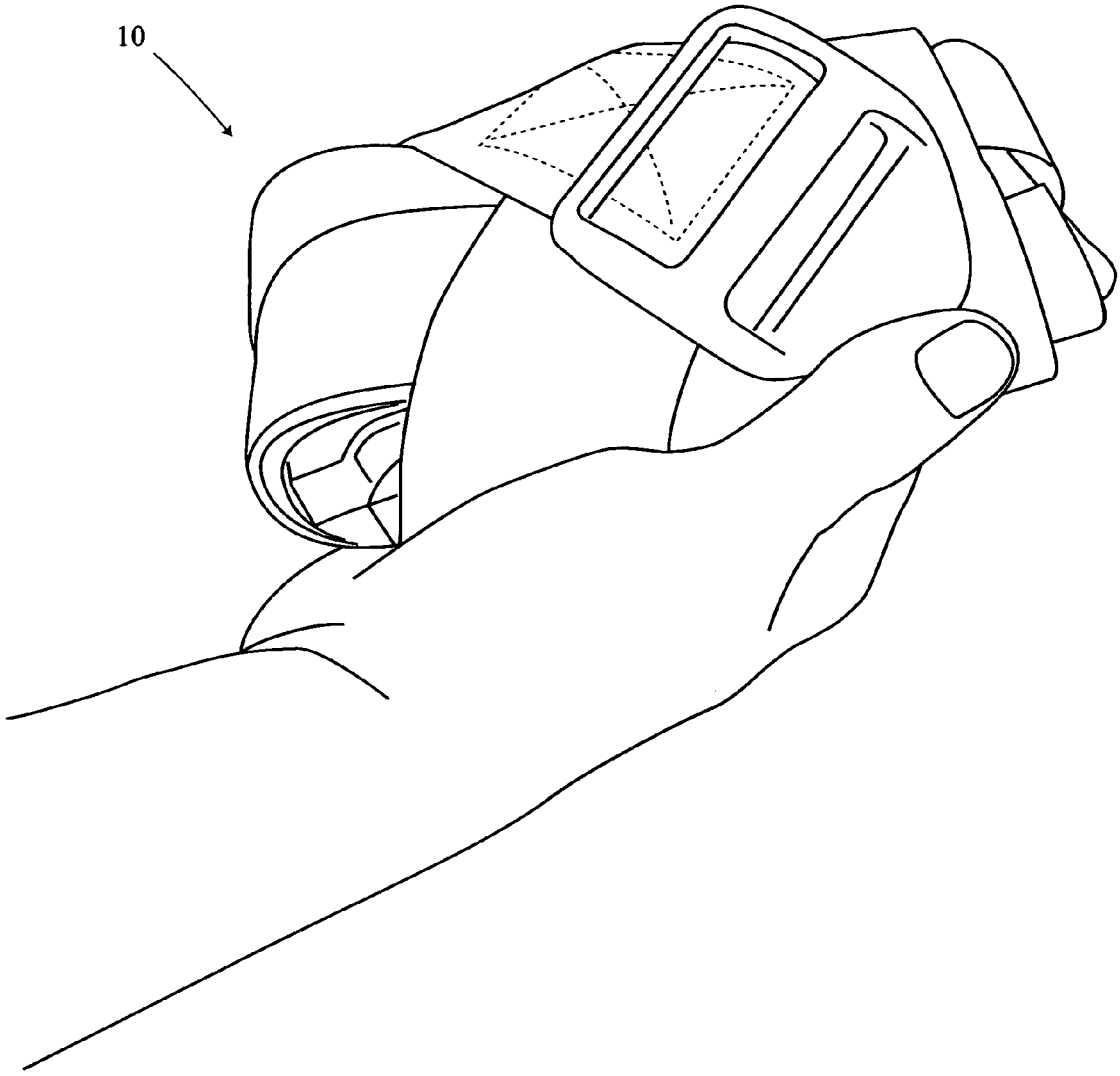
FIG. 5 Illustrates folded unit.

Turning now to FIG. 1, there is illustrated a deployed suspended toilet or chair apparatus 10. Apparatus 10 comprises of a main strap 20 which is folded to transition into left linear side 20*a* and right linear side 20*b*. Attaching through both sides 20*a*, 20*b*, at predetermined locations below the fold over of main strap 20, a loop is created. Support belt 12 slides through this loop which is used to attach toilet or seating apparatus 10 to any appropriate above ground supporting structure. Moving longitudinally downwards towards the bottom end of left linear side 20*a*, adjustable interlocking latch 22*a* is installed enabling a plurality of length adjustments accommodating a variety different sized people. Accordingly, moving longitudinally downwards towards the bottom end of right linear side 20*b*, adjustable interlocking latch 22*b* is installed to match adjustment versatility of left linear side 20*a*. Conjoined between the left linear side 20*a*, and right linear side 20*b* is a plurality of straps, seat box assembly 24. This assembly is comprised of transverse strap 26, first linear strap 28*c*, second linear strap 28*d*, interlocking latch 30*e*, and interlocking latch 30*f*. Seat box assembly 24 is to extend the width of left linear side 20*a*, and right linear side 20*b* where the user will be seated. Seat box assembly 24 also provides; (a) for location and rigid attachment of interlocking latch 30*e* at bottom end of first linear strap 28*c*, (b) for location and rigid attachment of interlocking latch 30*f* at bottom end of second linear strap 28*d*. By connecting adjustable interlocking latch 22*a* to interlocking ridged latch 30*e*, and adjustable interlocking latch 22*b* to interlocking rigided latch 30*f*, a pair of support loops are formed. In conjunction with support belt 12 deployed to an approved off ground anchor point, these support loops will surround and employ the right and left leg of the user to formulate a tripod support system for apparatus 10. Further examination of FIG. 1, shows conjointment between main strap sides 20*a*, 20*b*, and seat box assembly 24. At predetermined locations, left linear side 20*a*, right linear side 20*b*, and transverse strap 26 are to be overlayed and rigidly attached formulating; the seating area of apparatus 10, and formulating rigid connecting point for rigid interlocking latch 30*e* and adjustable interlocking latch 22*a* to assemble, forming support loop for left leg structure support. Repeating steps above on opposite side will form support loop for right leg structure support, concluding apparatus 10 basic strap formation. Further examination of FIG. 1 reveals predetermined location of hook portion 32, loop portion 34*a*, and 34*b* on surface side of apparatus 10. Component hoop portion 32 is to be installed directly beneath the loop of main strap 20. Component loop portion 34*a*, and 34*b* is the loop portion of a hook and loop connecting material, and is to be installed in seat box assembly 24. Loop portion 34*a* would be installed on to first linear strap 28*c* and main strap 20*a*, near interlocking rigid latch 30*e* is to be attached. Both loop portion 34*a*, and rigid interlocking latch 30*e* could be secured into position at the same time and by the same anchoring method. Loop portion 34*b* and rigid interlocking latch 30*f* are to be installed onto second linear strap 28*d* to mirror opposite side, first linear strap 28*c*. After personal usage of apparatus 10, placing loop portion 34*a*, and loop portion 34*b* to hook portion 32, user is able to shorten the girth of apparatus 10, protecting strap material from contact with the ground or human waste, if optional waste bag is not deployed. FIG. 1 reveals placement of clasp 36*g*, 36*h*, 36*i*, and 36*j*. These securing devices are to hold optional waste bag in position while apparatus 10 is deployed as a toiletry device. Placement and anchoring of all clasps are to be on the underside of apparatus 10. Clasp 36*g* is to be secured into place below hook portion 32 onto left linear side 20*a*, and above transverse strap 26. Clasp 36*h* is to be secured into place below hook portion 32 on right linear side 20*b*, and above trans-verse strap 26. Clasp 36*i* is to be installed onto first linear strap 28*c*, above loop portion 34*a*. Clasp 36*j* is to be installed onto second linear strap 28*d* above loop portion 34*b*. FIG. 4 demonstrates optional comfort embellishment knee pads 38*a*, and 38*b*. These can be added to increase sitting comfort longevity for the operator. Strap slots incorporated into knee pad 38*a*, and 38*b* would allow for left linear strap 20*a*, and right linear strap 20*b*, to be threaded through the slots allowing further comfort adjustment for the user.

Preferred material, but not limited to, for components; support belt 12, main strap 20, and seat box assembly 24, is nylon. Because of its strength, durability, and availability, and low cost, I feel nylon is the best product, however, other products such as leather, Kevlar, and plastic, would be perfectly suitable. For components; support belt buckle 14, adjustable interlocking latches 22*a*, 22*b*, and rigid interlocking latches 30*e*, 30*f*, I prefer plastic. Plastic is light weight, strong, and is available in a variety of different buckling devices currently on the market today. Brass, steel, or aluminum, could also be used but are generally heavier and more costly. Components; hook portion 32, loop portion 34*a*, and 34*b*, are generally made of nylon and or polypropylene, but with today's advances, other materials are certainly possible. For components; clasps 36*g*, 36*h*, 36*i*, and 36*j*, I prefer a metal construction over plastic because metal clasps should possess sharper teeth and will hold that sharpness for a much longer time. For the role these clasps must perform, a slip-out cannot be tolerated. For optional embellishment component knee pads 38*a*, and 38*b*, I prefer the pads made by McGuire-Nicholas/The Rooster Group. Comprised of a three layer foam system for ultimate comfort. These pads are ultra-light, semi-flexible, and with minimal alterations, will fit this device nicely. For optional component; refuse bag 40, any leak proof plastic bag of sufficient size would work, but I feel the best choice for this device would be The Wag Bag waste kit manufactured by Phillips Environmental Products Inc. This kit contains waste bag with gelling agent, odor neutralizer, decay catalyst, toilet paper, hand sanitizer, and one zip closed disposal bag.

Operation—FIGS. 6*a* Thru 6*g*

Grasp unit at the top 20 and turn it so that hook material 32 is facing operator, this side must always be faced out towards operator, (FIG. 6*a*).

Figure 6B:
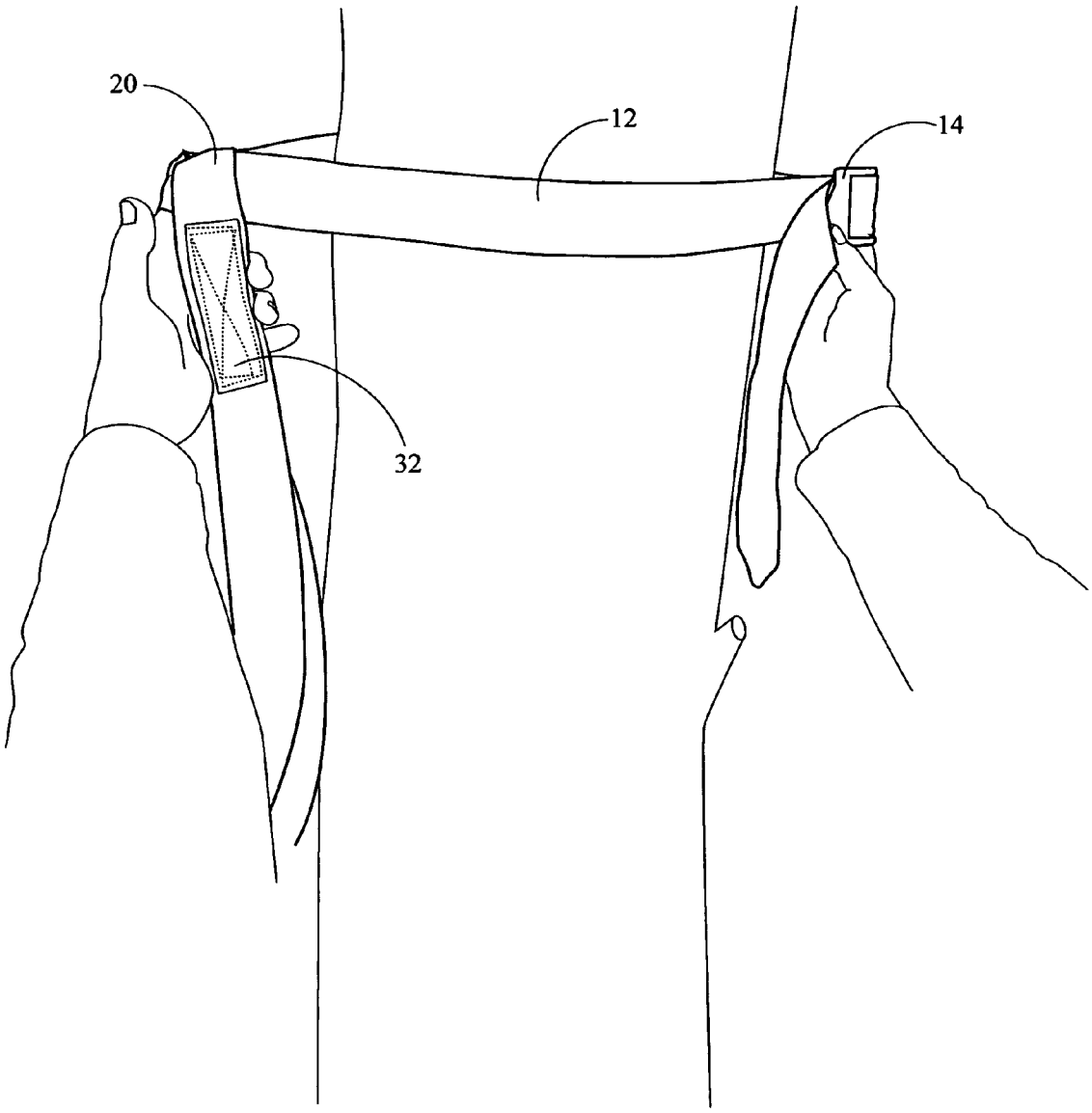
Figure 6C:
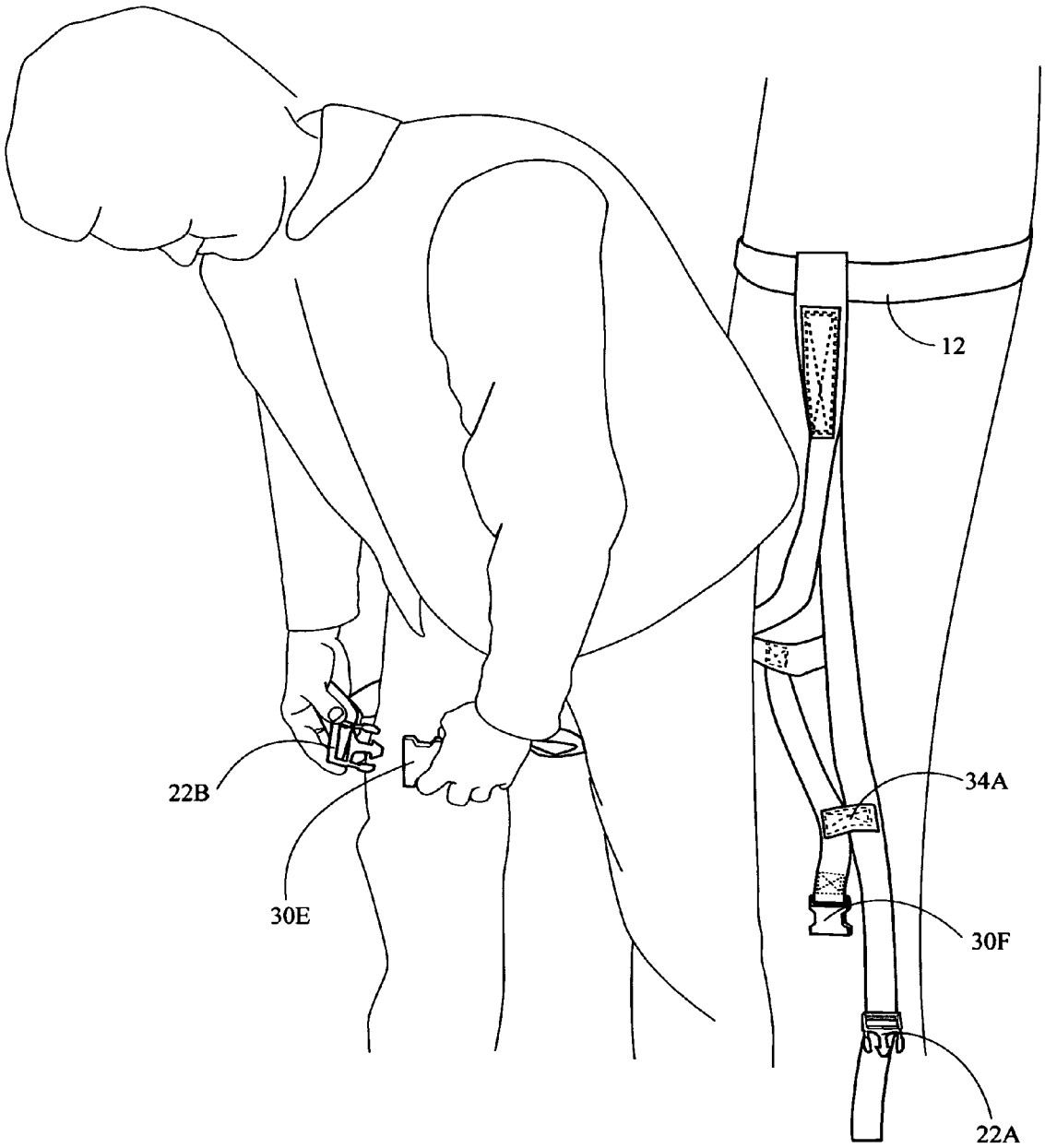

Attach and cinch support belt 12, approximately waist high, to suitable support, positioning belt buckle 14 towards away-side of main apparatus 10 (FIG. 6*b*).

With operator facing away from supported apparatus 10, bend forward at the hip and with left hand reaching between legs, grasp ridged latch 30*e* and hold. With right hand, collect adjustable latch 22*b* on the outside of right leg, and interlock latches together in front of right leg (FIG. 6*c*), do not cinch tight. Reversing hands, repeat above procedure with remaining appendage to left leg, do not cinch tight.

Figure 6D:
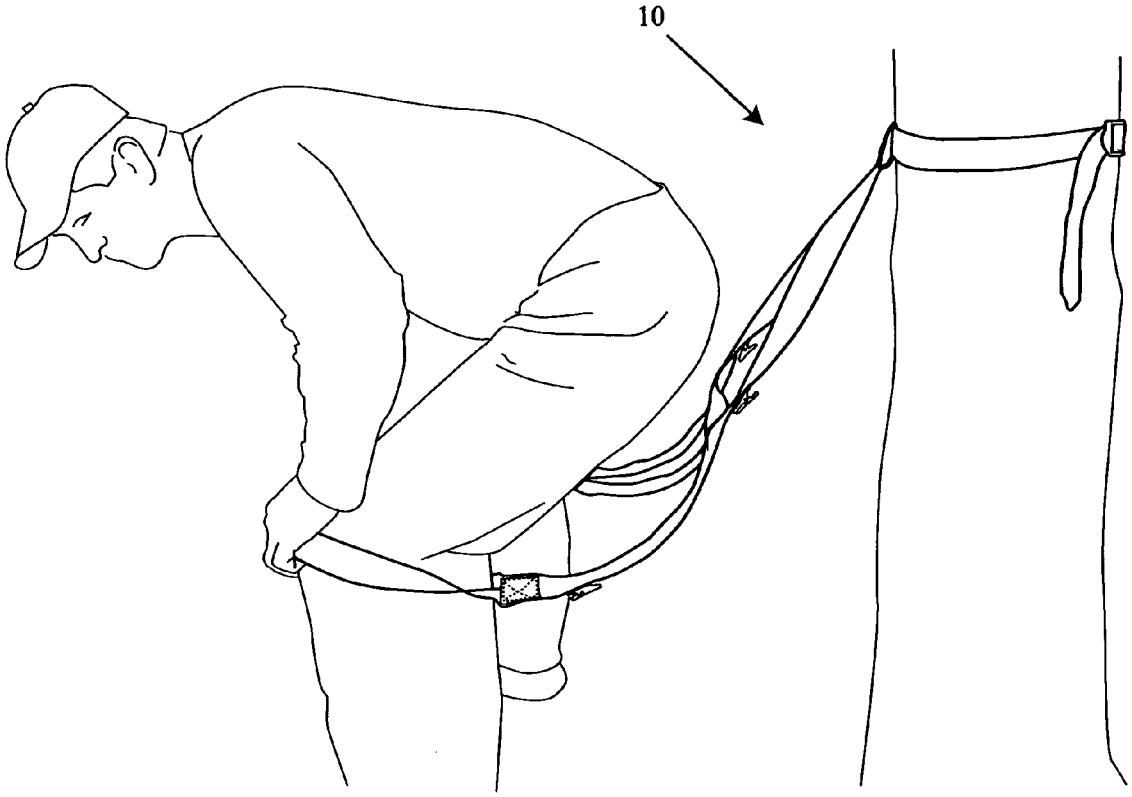

Standing approximately two feet in front of supported apparatus 10, hold leg loops to the knee caps, and swing backwards into a sitting position (FIG. 6*d*).

Adjust knee loop straps evenly so that transverse strap 26 is positioned no lower than the operators tail bone, (when deployed as a toilet).

To return to a standing position, simply swing forward and stand.

Figure 6E:
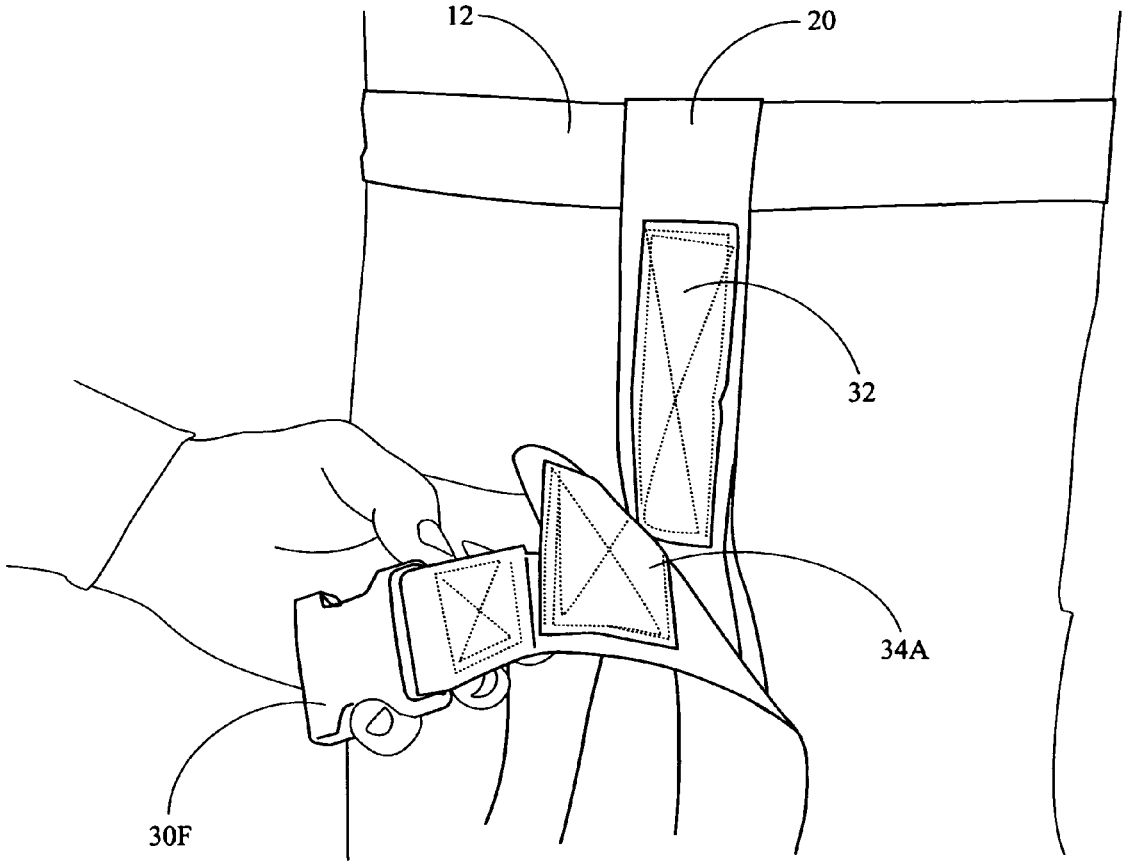
Figure 6F:
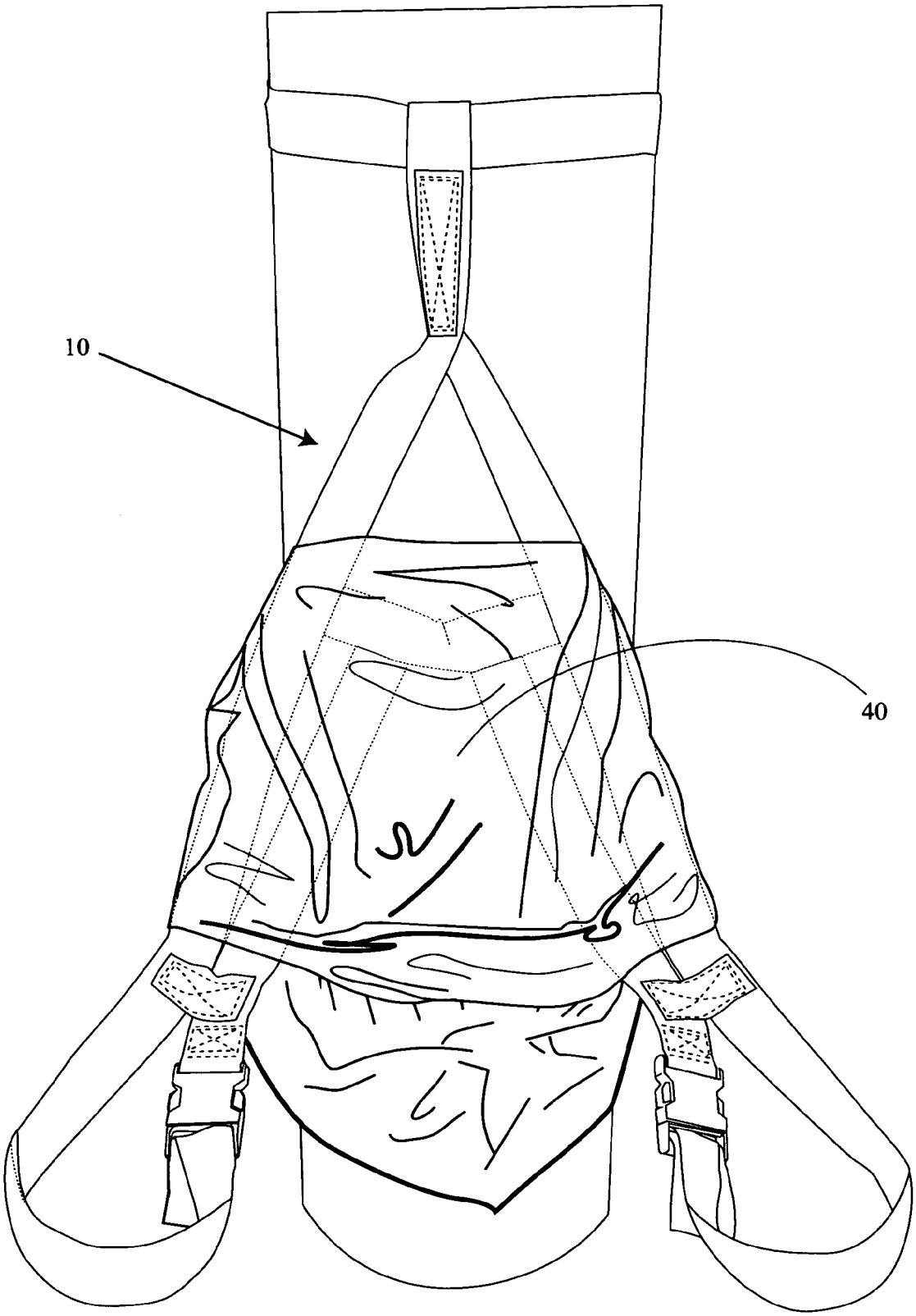

To avoid soilage of apparatus 10 after usage, loop portion 34*a*, and 34*b*, may be joined to hook portion 32, located just below support belt 12 (FIG. 6*e*).

Figure 6G:
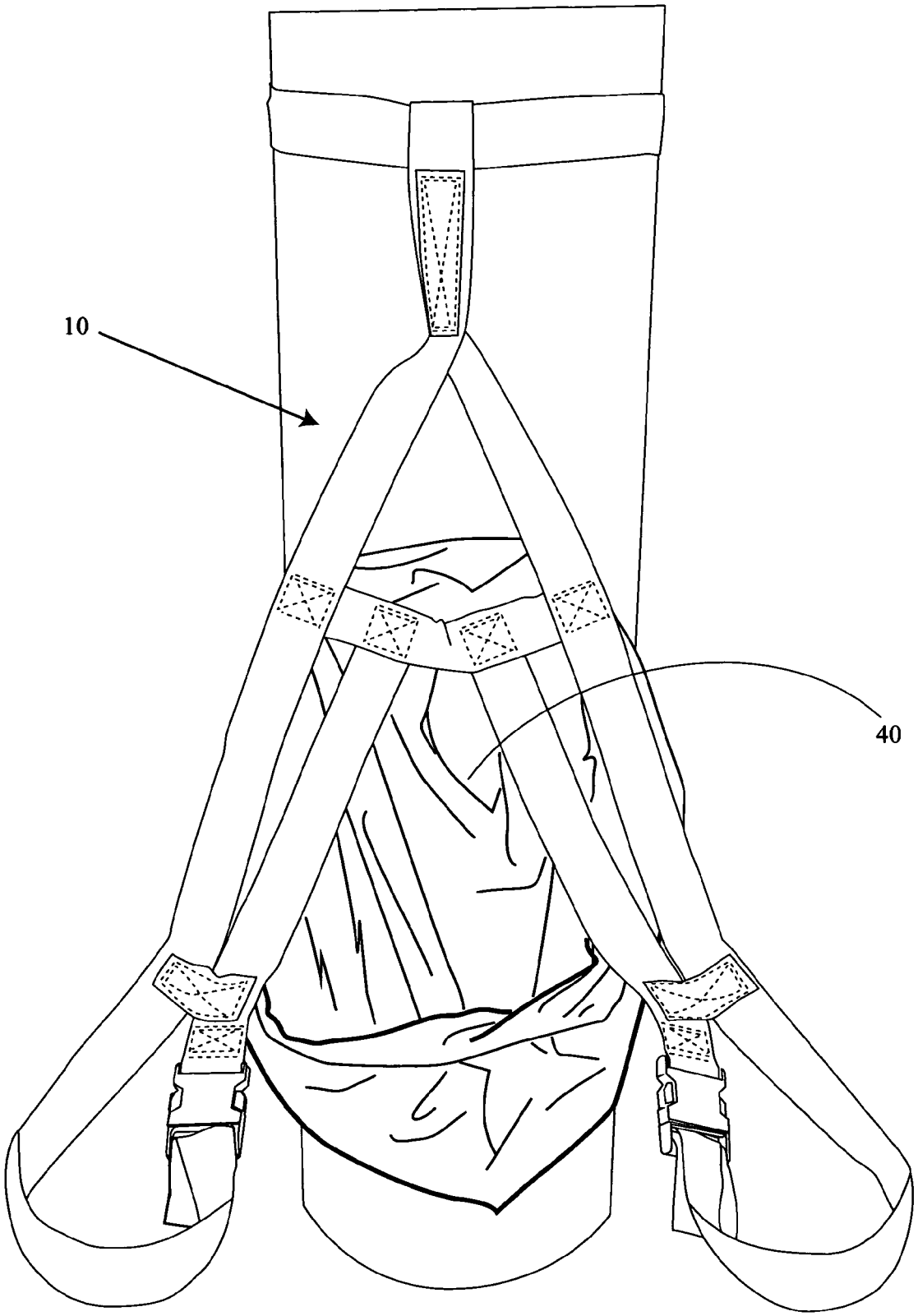

Refuse bag clasps 36*g*, 36*h*, 36*i*, and 36*j*, are located on the underside of apparatus 10. Optional refuse bag 40 can hang down directly from clasps or wrapped over top of strap material (FIG. 6*g*).

CONCLUSION, RAMIFICATIONS, AND SCOPE

In view of the present invention, the reader will experience the simplicity of the apparatus, the ease of deployment, as well as the convenience for which it represents. The present invention weighing only a few ounces and compacting down into such a small package, it is ideal for anyone to carry or store who could find themselves in a situation where a regular structured chair or toilet are just not available or practical.

This invention permits immediate access to a person for the need of a quick resting place or who is influenced by the call of nature to defecate. Since this invention is suspended above the ground, neither rain, snow or mud will detour operator's location of deployment. All that is required is a structure to suspend from, and little privacy!

One interesting use for the present invention could be in a case of a natural disaster, where folks are unexpectedly expelled from their homes because of a wild fire, a flood, or a mud slide. Hurricane Katrina is a good example. The people forced from their homes and herded into the Astro-Dome for temporary shelter, soon found themselves without basic toilet facilities due to the failure of the entire system. It was said that the stench of excrement throughout the building was horrendous, because people were defecating everywhere including the main hallways. This invention could have been an excellent detourant from such a scenario. Issuing this simple apparatus together with a refuse bag could have controlled 'the mess' and could have been sanitarily removed via regular trash cans and collected much later by sanitation workers. I believe everyone could find this invention handy, and when the need arises, just "click-it and stick-it"!

I claim:

1. A sitting or defecating apparatus for supporting a user in a sitting position while the user's feet are planted, comprising:

an off ground suspension anchor securable to a stationary object behind the user;

a right strap and a left strap attached to and extending from the suspension anchor;

the right strap comprises a right loop portion formed by attaching two intermediate portions of the right strap to form a right leg support loop, the right leg support loop can be wrapped around the user's bent right leg at or below the knee;

the left strap comprises a left loop portion formed by attaching two intermediate portions of the left strap to form a left leg support loop, the left leg support loop can be wrapped around the user's bent left leg at or below the knee;

a seat box assembly formed of flexible strap material which supports the user's buttocks in the sitting position, the seat box assembly being suspended from the right leg support loop, the left leg support loop, and the off ground suspension anchor;

the seat box assembly comprises a transverse strap, wherein an end of the right strap and an end of the left strap are attached at the transverse strap;

the transverse strap is attached to the right strap at a position on the right strap between the suspension anchor and the right leg support loop; and the transverse strap is attached to the left strap at a position on the left strap between the suspension anchor and the left leg support loop.

2. The sitting or defecating apparatus of claim 1 in which the off ground suspension anchor is coupled to an adjustable main support loop.

3. The sitting or defecating apparatus of claim 2 in which the right and left leg support loops are each adjustable.

4. The sitting or defecating apparatus of claim 1 in which the seat box assembly includes a plurality of clasps for holding a waste bag below the user's buttocks.

5. The sitting or defecating apparatus of claim 1 further comprising a defecation capture bag removably mounted to the seat box assembly so as to be below the user's buttocks.

6. The sitting or defecating apparatus of claim 1 further comprising means for releasably holding the seat box assembly in a folded orientation above the ground when the leg support loops are not wrapped around the user's leg.

7. The sitting or defecating apparatus of claim 6 in which the means for releasably holding comprises at least one set of hook and loop fasteners for securing at least one of the leg support loops to the off ground suspension anchor when the off ground suspension anchor is secured to the stationary object.

8. The sitting or defecating apparatus of claim 1 in which the seat box assembly comprises a first elongated strap suspended between the suspension anchor and the right leg support loop, a second elongated strap suspended between the suspension anchor and the left leg support loop, and a transverse strap suspended between the first and second elongated strap.

9. The sitting or defecating apparatus of claim 8 in which the transverse strap is located at or above the user's tailbone.

10. A method for supporting a human user in a sitting position, comprising:

providing a seat box assembly formed of flexible strap material which supports the user's buttocks in the sitting position, the seat box assembly being suspended from a right leg support loop, a left leg support loop, and an off ground suspension anchor;

the seat box assembly comprises a transverse strap, wherein an end of the right strap and an end of the left strap are attached at the transverse strap;

the transverse strap is attached to the right strap at a position on the right strap between the suspension anchor and the right leg support loop; and the transverse strap is attached to the left strap at a position on the left strap between the suspension anchor and the left leg support loop;

suspending a rear side of the seat box assembly from a stationary object;

suspending a right front portion of the seat box assembly from a right front support loop wrapped around the user's right leg at or below the knee; the right front support loop formed by attaching two intermediate portions of the right strap to form a right leg support loop;

suspending a left front portion of the seat box assembly from a left front support loop wrapped around the user's left leg at or below the knee; the left front support loop formed by attaching two intermediate portions of the left strap to form a left leg support loop;

and using the suspended seat box assembly to support the user's buttocks in a sitting position while the user's legs are bent and the user's feet are planted.

11. The method of claim 10 in which the seat box assembly defines an open space and the user's buttocks are positioned so as to allow defecation to pass through the open space of the seat box assembly.

12. The method of claim 11 further comprising positioning a defecation capture device below the open space of the seat box assembly.

13. The method of claim 12 in which the defecation capture device is a bag and the bag is suspended from the seat box assembly.

14. The method of claim 10 in which suspending the rear side of the seat box assembly comprises wrapping an adjustable strap to a tree.

15. The method of claim 10 further comprising bringing the right and left front portions of seat box assembly towards the rear side of the seat box assembly to place the seat box assembly into an above ground folded orientation when not in use.

16. The method of claim 15 further comprising using hook and loop fasteners to hold the seat box assembly in the above ground folded orientation.

17. The method of claim 10 in which the seat box assembly includes a first elongated section suspended between the stationary object and the right front support loop, a second elongated section suspended between the stationary object and the left front support loop, and a transverse section suspended between the first and second elongated sections.

18. The method of claim 17 in which the transverse section is positioned at or above the user's tailbone.

* * * * *